US007140429B2

(12) United States Patent
Grebennikov et al.

(10) Patent No.: US 7,140,429 B2
(45) Date of Patent: Nov. 28, 2006

(54) DEVICE FOR CUTTING OF SLOT-LIKE KEY SEATS IN WELLS BY A HYDROABRASIVE METHOD

(75) Inventors: Valentin Timofeyevich Grebennikov, Moscow (RU); Anatoly Ivanov, St. Petersburg (RU); Artem Ivanov, St. Petersburg (RU)

(73) Assignee: Nord Service Inc., Little Rock, AR (US)

( * ) Notice: Subject to any disclaimer, the term of this patent is extended or adjusted under 35 U.S.C. 154(b) by 0 days.

(21) Appl. No.: 10/957,871

(22) Filed: Oct. 4, 2004

(65) Prior Publication Data

US 2006/0070730 A1 Apr. 6, 2006

(51) Int. Cl.
*E21B 43/114* (2006.01)

(52) U.S. Cl. ..... 166/55

(58) Field of Classification Search ..... 166/55, 166/55.1, 55.2, 298
See application file for complete search history.

(56) References Cited

U.S. PATENT DOCUMENTS

| | | | | |
|---|---|---|---|---|
| 2,315,496 | A * | 4/1943 | Boynton | 175/67 |
| 2,934,146 | A * | 4/1960 | Laval, Jr. | 166/55 |
| 2,974,727 | A * | 3/1961 | Goodwin | 166/55 |
| 3,022,826 | A * | 2/1962 | Kisling, III | 166/100 |
| 3,130,786 | A * | 4/1964 | Brown et al. | 175/424 |
| 3,175,613 | A * | 3/1965 | Parker et al. | 166/298 |
| 5,337,825 | A * | 8/1994 | Marmorstein et al. | 166/307 |
| 5,381,631 | A * | 1/1995 | Raghavan et al. | 451/75 |
| 5,445,220 | A * | 8/1995 | Gurevich et al. | 166/55 |
| 6,652,741 | B1 * | 11/2003 | Marinzet | 210/101 |

* cited by examiner

*Primary Examiner*—Hoang Dang
(74) *Attorney, Agent, or Firm*—Houston Eliseeva LLP

(57) ABSTRACT

The invention relates to the field of mining, namely, to the oil and gas extraction, hydrogeologic, engineering and the geologic and water supply industry and provides an apparatus for the cutting of slot-like key seats in the well bore zone of productive strata by hydraulic abrasion.

10 Claims, 5 Drawing Sheets

DEVICE FOR CUTTING OF SLOT-LIKE KEY SEATS IN WELLS BY A HYDROABRASIVE METHOD

FIELD OF THE INVENTION

This invention relates to the mining industry and more particularly to the oil-and-gas extracting industry, hydrogeological industry, engineer-geological industry and water-supplying industry, and is intended for the use when cutting slot-shaped key seats by hydro-sandblasting method in the wellside zone of productive bed.

BACKGROUND OF THE INVENTION

The slot relieving of wellside zone of producing beds is known as one of the most effective methods for increasing productivity (output) of oil, gas, fill-in, hydrogeological, engineer-geological or water-supplying well.

This method provides creating of slots in the wellside zone, wherein the width, depth and orientation of the slots are predefined by known methods according to characteristics of the well and productive bed.

Practical cutting of slots having predetermined parameters is a very difficult technical problem, since the cutting is performed in complicated conditions of various rocks, temperatures, at great depth, in the presence of extracted product and/or washing liquids in the welbore, with remote control and monitoring only. One of the most successful techniques for cutting slots is the sandblasting hydro-abrasive perforation, in which the cutting is performed with a jet of water and sand at a very high pressure of liquid. Apparatus for implementing this technique is shown in close-up in FIG. 1. It comprises a tubing (pipe) 1 which is rigidly joined with a housing tube (housing pipe) 2, within which an inner tube 4 is moveably mounted coaxially relative to housing 2 (and to a gap 3), the inner tube being spring-loaded from below with a cock spring 5. A ball valve 6 is mounted at the edge of inner tube 4, and a perforator 7 is mounted above that valve. In the inter tube gap 3, a hydro-brake 8 is formed comprising two vertical hermetic chambers 9 and 10 constrained by plugs 11 and 12. The chambers are filled with liquid and separated by a piston 14 having a channel 15 for cross-flow of liquid between the chambers, the top plug 11 being rigidly joined with the case 2 and moveably joined with the inner tube 4. The piston 14 is rigidly joined with the inner tube 2 and moveably joined with the case 2. The bottom plug 12 is moveable relative both tubes.

The apparatus in FIG. 1 operates as follows. The outer tube 2 is jointed by means of pipe coupling (like a collar) with the tubing 1. The second end of tubing 1 is connected to a pump unit of the equipment on the surface. The top chamber 9 is filled with viscous liquid, wherein the amount of liquid for each cutting process is chosen in accordance with the slot length and depth calculated in advance, based on the known parameters of the channel 15 (capillary) connecting the chambers 9 and 10, temperature dependence of the sizes of the channel and the fluidity of liquid, as well as the pressure of the pump unit.

Then the housing 2 of the apparatus (along with the inner tube 4, hydro-brake 8, cock device 5, hydro-abrasive perforator 7, and ball valve 6 disposed therein) is lowered to the predetermined depth, so that nozzles of hydro-abrasive perforator 7 are in the place of the well where the top edge of the formed slot should be cut. A ball is dropped into the inner tube 4 (in order to close the ball valve 6). The pump unit of the surface equipment is then turned on, and it begins to pump the abrasive mixture with the predetermined (rated) pressure into the inner tube 4. The mixture passes down to the ball valve 6 and closes it tightly. The hydro-abrasive perforator 7, via nozzles, begins to cut slots, first in the casing walls, then in the wellside zone. The depth of cutting of a future slot depends, in particular, on the time during which the cutting is performed. Pressure within the inner tube 4 (through which the abrasive liquid is pumped under pressure) pushes the inner tube 4 down and out of the outer tube (housing) 2 rigidly mounted on the tubing 1. A slow cross-flow of liquid from the top chamber 9 of hydro-brake 8 into the bottom chamber 10 occurs, predetermined by the time of the cross-flow defined by the channel 15. Thus, the inner tube 4 with the perforator 7 mounted thereon is slowly lowered down, and the rate of its movement defines the depth of (slot) cutting. At that time, only the cock spring 5 pushes from below against the plug 12 of the bottom chamber 10, which pressure is chosen essentially less than the pressure against the top plug 11. In other words, the pressure of the cock spring 5 does not impede the liquid to cross-flow from the top chamber 9 into the bottom chamber 10. This process of slow lowering (in the presence of pressure in the tubing 1) lasts until all the oil from the bottom chamber is forced to flow into the top chamber. I.e., the characteristics of liquid poured initially into the bottom chamber 9 define the height of cutting, or the future slot. The duration of the cross-flow defines the rate of lowering of the apparatus for cutting slots, i.e., the depth of cutting of such slot. If the necessary cutting height is achieved before all the oil in the top chamber cross flows into the lower chamber, then at that moment the pressure in the tubing 1 is released, and the process of cutting the slot and the liquid cross-flow is stopped. In doing so, since the pressure against the top plug 11 of hydro-brake 8 is stopped, the cock spring 5 pushes liquid out of the top chamber 9 into the bottom chamber 10 while raising the inner tube 4 into its initial position. The same process occurs after all the oil is squeezed into the bottom chamber 10, if the pressure in the tubing 1 is withdrawn at that time.

An effective example of such an apparatus for cutting slots by hydro-abrasive perforator, which apparatus being used for developing production columns with a slot and creating vertical relieving slot-shaped cavities in the wellside zone, could be the apparatus КШР4, the design of СКБТМГРПГО<<Севморгеология>>[Special Designing Bureau "Sevmorgeologiya", RU], which operates in the above described manner. Known are another similar apparatuses. The closest analog is the apparatus according the U.S. Pat. No. 6,652,741 issued Nov. 25, 2003.

Now the processes taking place in the process of cutting slots by hydro-abrasion will be analyzed. Essentially in all known apparatuses of this type, a movement of the hydro-abrasive perforator 7 occurs from top to bottom by a pressure in the tube space. The pressure in the tube space is created for operation of a hydro-abrasive jet. Because of the pressure differential between the tube space and the annular space (outside the tube) at hard-alloy nozzles of the hydro-abrasive perforator 7, an abrasive particle is "charged" with energy (the particle outlet velocity from the hard-alloy nozzle reaches several meters per second). When hitting the production column wall and then the rock, a particle "performs" work: it destroys metal and rock. Hydro-abrasive perforator 7 is lowered into a well on tube 1. The main part in this apparatus is the hydro-brake 8, sealed relative to the housing 2, which is rigidly joined with the column of tube 1. The inner tube 4 sealed relative to the housing 2 can move a fixed distance limited by top plug 11 and bottom plug 12. The piston 14 is disposed in the middle of a stroke between the plugs, which piston is implemented as a seal having a capillary through hole, i.e., the channel 15. The space between the top plug 11 and the piston 14 with the capillary, which is previously referred to as the top chamber 9 of hydro-brake 8, is filled with viscous liquid. The space between the bottom plug 12 and the piston 14 with the capillary, which is previously referred to as the bottom chamber 10 of hydro-brake 8, is filled with viscous liquid. Pressure in the tube space causes the displacement of the inner tube 4 relative to the housing 2 due to the cross-flow of viscous liquid from the bottom chamber 10 into the top chamber 9. The rate of that displacement is adjusted by the length and the cross-section of the capillary, and the selection of the viscosity of the liquid and the cross-section and length of the capillary, so that the displacement rate is predetermined for the optimal operation of hydro-abrasive perforator 7 under the conditions of the face of well (the temperature and working pressure in the tube space).

The bottom seal-plug 12 is made moveable relative to the inner tube 4 and housing 2, and the bottom plug 12 is spring-loaded relative to the housing by the cock spring 5. Thus, pressure is created in the bottom chamber 10 of hydro-brake 8 of hydro-abrasive perforator 7, which pressure ensures the initial position of the bottom plug 12, and, therefore, the inner tube 4 with the hydro-abrasive perforator 7, in the upper top position. Pressure of the cock spring 5 in the bottom chamber 10 of the engine of hydro-abrasive perforator 7 (cock force) is chosen such that this force ensures the raising of hydro-abrasive perforator 7 into the upper top position not exceeding 30% of the forward stroke force exerted by the working pressure in the tube space.

More commonly, the back stroke or the cock of the engine of hydro-abrasive perforator 7 occurs due to the straightening the spring 5 which encompasses the inner tube 4 inserted between the housing of hydro-brake 8 and hydro-abrasive perforator 7. The lower end of the cock spring 5 is pushed against the perforator housing, and spring's upper end is pushed against the bottom plug 12 of the hydro-brake 8. A displacement of the inner tube 4 relative to the case 2 compresses the spring 5 because of working pressure in the tube space. Once the pressure in the tube space and the annular space is equalized, the spring 5 straightens and pushes out the inner tube 4 with the perforator 7 into the upper top position.

The signaling device 35 ensures control of the rate of displacement of hydro-abrasive perforator and provides information about completion of the working stroke of the hydro-abrasive perforator. This device is, e.g., all upward pin mounted under the ball valve 6 at a holder rigidly jointed with the housing 2. Said pin opens up the ball valve 6 at the end of the working stroke of hydro-abrasive perforator 7, at which time the pressure in the tube space drops sharply, informing of the completion of the working stroke.

Using such apparatus, it is possible to open up a production column and create slot-shaped key seats in the wellside zone of the productive bed. During operation of such apparatus in a well, a foreman gets information on the hydro-abrasive perforator displacement rate, the completion of hydro-abrasive perforator engine working stroke, the condition of the hard-alloy nozzles during the operation. There is a possibility to initiate forward or backward washing of the well at any stage of the operation in the well, supply the fraction-treating solution, drive the pressurized solution into a formation, and, when necessary, perform the hydraulic formation fracturing.

In spite of the merits of said apparatus, there are some the common drawbacks:

Unpredicted stoppages and alterations of rate (depth) of slot cutting are unavoidable, since all the known hydro-abrasive perforator engines work on the principle of a hydro-brake: the cross-flow of viscous liquids from one chamber to another through a capillary, i.e., a movement rate is set by the capillary's length and cross-section. The reason for stoppages and alterations is the attenuation of the movement of the liquid movement through the capillary. In the case of such a stoppage or essential alteration of the rate, it is necessary to raise the face equipment and readjust it. This is a very costly and lengthy operation.

Dependence of the slot forming rate on temperature. It is known that the viscosity of a liquid depends on its temperature. In order to set the rate of the movement (displacement) of hydro-abrasive perforator of the apparatus in a well during operation (i.e., under the real conditions), it is necessary to perform a series of complicated operations on the surface. The operations related to simulating the working conditions in a well and to calculating a face temperature changes during stoppages while washing the well, and at various rates of pumping in cycle and during the discharge. In addition, the accuracy of such calculations is rather low, which reflects on operation quality and reliability.

Duration of operation for opening a ball valve at the perforator edge, i.e., the operation of extracting said ball. The ball valve is opened by a backward washing process at a speed permitting to raise the ball up to wellhead and to extract it from the tube space. Depending on the depth of the operation, the operation of extracting the metal ball from the tube space requires from one to three, and sometimes five hours. It is necessary to close the ball valve in order to resume a hydro-abrasive perforator working stroke and to maintain pressure differential at the hard-alloy nozzles in the perforator. This procedure is implemented by repeatedly inserting the metal ball into the tube space. Once reaching the hydro-abrasive perforator, the metal ball blocks the aperture in its edge. Supply of working liquid—the pulp—will occur thereafter only through the hard-alloy nozzles. In order to switch to other operation, such as the forward or backward washing of well, insertion of technological solution, replacement of the pulp by a technological solution, hydraulic fracturing of formation, etc., it is again necessary to have a forward open edge of the hydro-abrasive perforator, or else all the operations having to do with the supply of the liquid into tubing 1 encounters the hydraulic resistance of the hard-alloy nozzles.

Presence of signaling device in the lower part of the face equipment, in fact, shuts off the "forward" flow of the liquid from the hydro-abrasive perforator's edge. It is impossible to perform cleaning of a sump in the well from the accumulated sludge and sand, and it is impossible to place an instrument onto the face in order to packer release it and for other purposes.

In other words, the known apparatuses are insufficiently efficient, insufficiently convenient, reliable, stable in time, and they are temperature dependent.

SUMMARY OF THE INVENTION

The object of the invention is to decreasing the enumerated drawbacks, and specifically, to increase the efficiency of an apparatus for cutting slot-shaped key seats in a well by hydro-sandblasting method, to increase convenience, reliability and temporal stability of that apparatus, as well as to decrease its temperature dependence.

This object is solved by the improvement in the known apparatus for cutting slot-shaped key seats in a well by hydro-sandblasting method. In particular, said apparatus comprised a tube housing rigidly and hermetically joined with an end of the pump-compressor tubing within which an inner tube is moveably and coaxially mounted with regard to a gap. Said inner tube is spring-loaded from below with a cock spring, wherein at the lower end of said inner tube is mounted a hydro-abrasive perforator with a ball valve, wherein the perforator is disposed above the ball. A hydro-brake is disposed inside the gap between the inner tube and the tube housing and includes two vertical hermetic chambers limited by a top plug and a bottom plug, wherein said chambers are filled with a viscous liquid and divided by a piston with a hole for the cross-flow of said viscous liquid between said chambers. The top plug is rigidly joined with the housing and moveably joined with the inner tube, the piston is rigidly joined with the inner tube and moveably joined with the housing, and the bottom plug is moveable relative said both tubes. The essential improvements and additions are the following:

the channel between said chambers of the hydro-brake is made self-adjusting, e.g., in the form of elastically pressed against each other a matrix and a punch which can shift relative to each other. The matrix and the punch have matching recesses and protrusions of the same shape, the protrusions being larger than the recesses;

the recesses and protrusions of said matrix and punch could be chosen in the shape of a trapezoid;

the recesses of said matrix could be chosen in the shape of a trapezoid and the protrusions of said punch could be chosen trianglular;

the matrix of the hydro-brake could be made of elastic material (for example, of caprolactam, a variety of the polytetrafluorethylene rubber, etc.) having the lesser hardness than the punch (for example, aluminum);

the recesses and protrusions of said matrix and punch could be the concentric circles, wherein the inlet of the channel for cross-flow of a viscous liquid is disposed in the center;

the materials of the matrix and the punch of the hydro-brake can have different thermal expansion coefficients, for example, the matrix can be made of caprolactam and the punch can be made of aluminum. Thus, it is possible to decrease the influence of temperature changes by altering the channel cross-section proportionally to the temperature, so that the volume of the cross-flowing liquid remains constant.

Besides, after checking the hermetical tightness of the pumping-compressing tubing column prior to cutting slots and at the completion of work, an upper ball valve could be mounted onto the upper end of the inner tube to eliminate the step of washing out the ball valve, wherein the diameter of the upper ball valve is greater than the diameter of the lower ball valve, A socket for catching the balls is disposed above the valve, which socket is divided by vertical walls into three sectors, the first sector being connected at the bottom only with the second, adjacent sector, the second sector being connected at the top with the upper end of the socket by a passage, wherein the second and third sectors being connected to each other in their upper part by a hole having a diameter greater than the diameter of the largest ball. A reflecting lattice is disposed between the upper end of the inner tube and the pumping-compressing tubing and above the second and third sectors. The cell size of the lattice is smaller than the diameter of the smaller ball. The lattice is made tilted relative to the socket wall, rising to the socket wall at an angle of at least 60°.

Moreover, in order to cut slots not only along the generator line of the tubing column cylinder, but at a given angle (pitch) to the generator line, the apparatus is enhanced with a guiding template disposed above the perforator housing and rigidly connected with the housing, said template being made in the form of a tube with slots into which the heads of the pins mounted on the lower part of the cock housing are inserted. The slots and the pins define a trajectory of the displacement of the hydro-abrasive perforator's nozzles along the cock housing.

Moreover, in order to receive a signal about the completion of the perforator stroke, through openings/orifices could be made in the tube housing above the upper plug, the openings/orifices being normally closed with the differential piston. The moveable gate of the differential piston is implemented with an option to open during a downwards vertical displacement. At the upper end of the inner tube an external protrusion is made for engaging the moveable gate of the differential piston.

BRIEF DESCRIPTION OF THE DRAWINGS

The essence of the invention is explained with the following drawings.

DETAILED DESCRIPTION OF THE INVENTION

Figure 1:
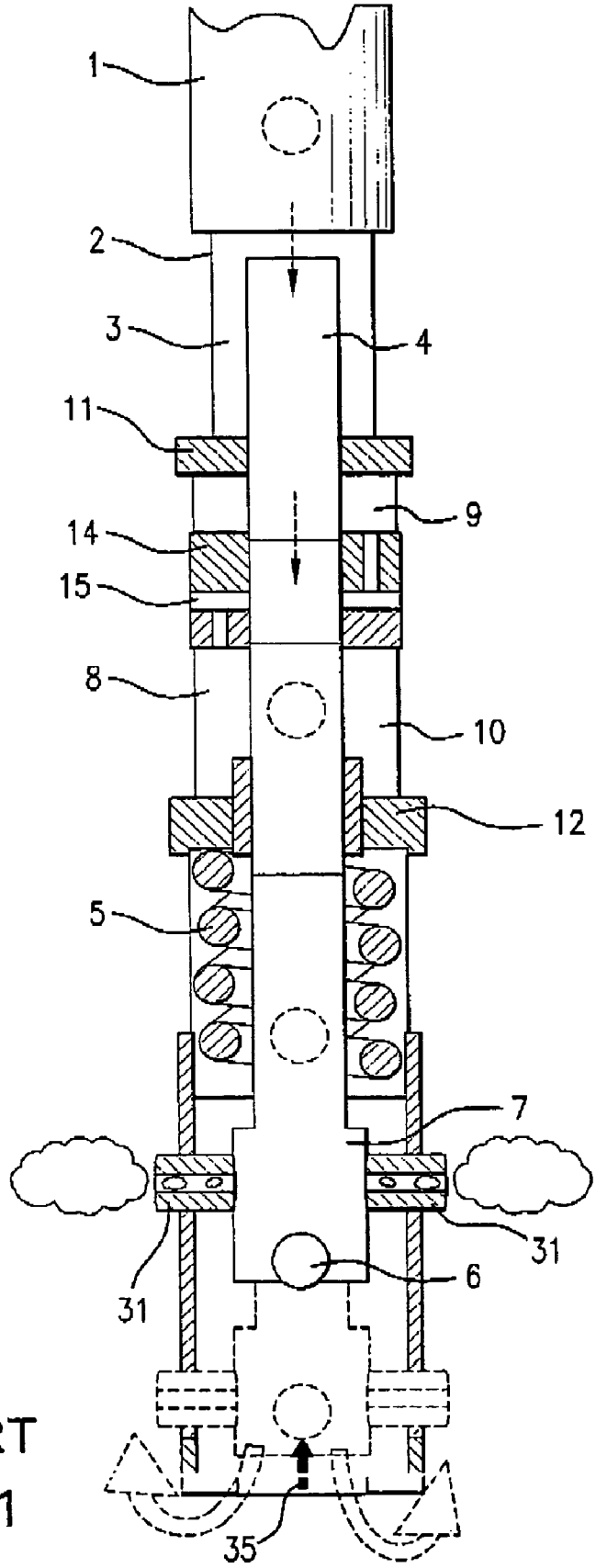
PRIOR ART FIG. 1
FIG. 1 shows an example of a structural diagram of the apparatus for cutting slot-shaped key seats in a well by a hydro-sandblasting method.

The following references are included in the drawings:

1—the tubing; 2—the housing, the outer tube; 3—the gap between tubes of the apparatus; 4—the inner tube; 5—the cock device; 6—the ball valve; 7—the hydro-abrasive perforator; 8—the hydro-brake; 9 and 10—the top and bottom chambers; 11 and 12—the top and bottom plugs; 14—the moveable piston between the chambers; 15—the channel in the piston; 16—the body of a dosing device; 17—the punch; 18—the matrix, 19—the spring; 20—the press; 21—channels of free cross-flowing of a liquid; 22—the guiding template; 23—the template slot; 24—pins; 25—the socket for catching balls; 26—dividing walls; 27—the first sector; 28—the second sector; 29—the third sector; 30—the reflecting lattice; 31—through openings/orifices; 32—the differential piston; 33—the differential piston's moveable gate; 34—external projections of the inner tube (for engaging the differential piston's moveable gate); 35—the signaling device.

The structure diagram of the apparatus (as well as the closest analog in FIG. 1) comprises a pumping-compressing tubing 1 rigid joined with a housing tube 2. Within housing 2 an inner tube 4 is mounted moveably and coaxially relative the housing 2 (coaxially also relative to a gap 3), the inner tube being spring-loaded from below with a cock spring 5. A ball valve 6 is mounted at the edge of inner tube 4, and a perforator 7 is mounted above that valve. In the inter tube gap 3, a hydro-brake 8 is mounted, the hydro-brake comprising two vertical hermetic chambers 9 and 10. Said chambers are limited at the top and at the bottom by plugs 11 and 12, the chambers are filled with a viscous liquid. They are separated by a piston 14 having a through hole 15 for the cross-flow of a liquid between chambers. The top plug 11 is rigidly joined with the housing 2 and moveable joined with the inner tube 4. The piston 14 is rigidly joined with the inner tube 4 and moveable joined with the housing 2. The bottom plug 12 is moveable relative both tubes.

Figure 2:
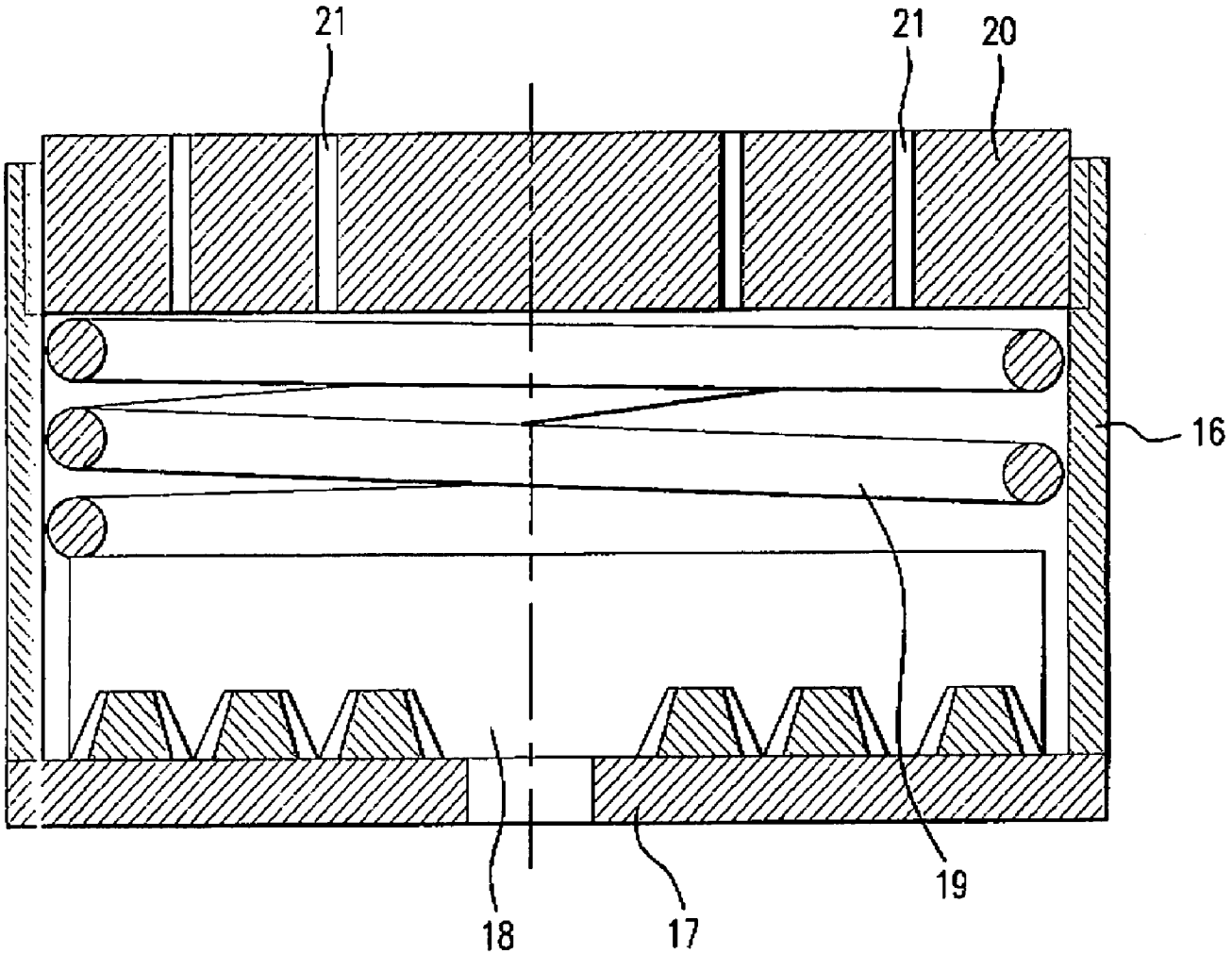
FIG. 2 shows an embodiment of an assembly for a cross-flow of a liquid between the hydro-brake chambers.

Referring to FIG. 2, an embodiment of the channel for the cross-flow of a liquid between the two hydro-brake's chambers, i.e., the assembly for the cross-flowing of a brake liquid/fluid, comprises the housing 16 with its lower base being the punch 17. The matrix 18 is overlaid and pressed to the punch 17 with the spring 19 and press 20 threaded into the housing 16. Channels 21 for the free cross-flowing of the fluid are made through the massive press 20.

Figure 3:
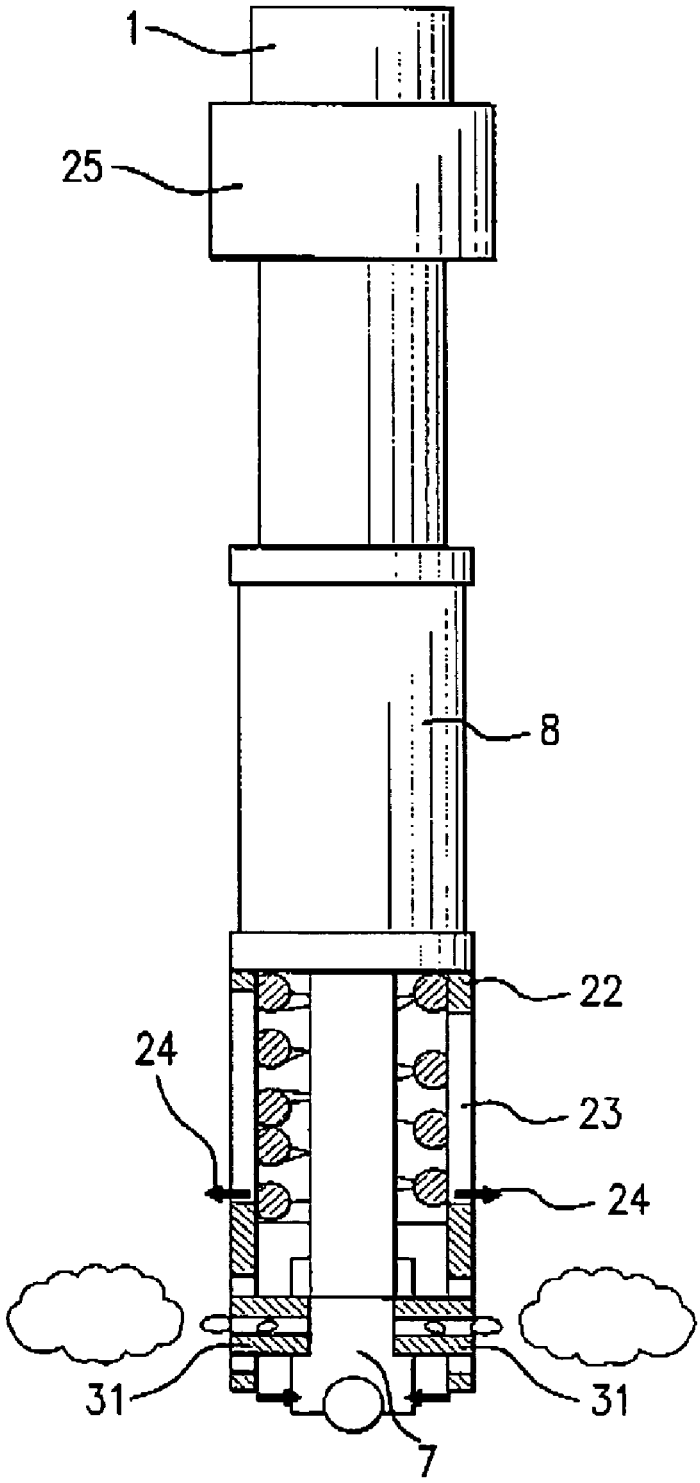
FIG. 3 shows an embodiment of the guides for determining the slot cutting trajectory.

Referring to FIG. 3, an embodiment of guides for determining the slot cutting trajectory comprises the guiding template 22 jointed rigidly with the housing of perforator 7; pins 24 are inserted into the slots 23 of the template 22, which pins are screwed into the housing of the cock spring 5. As the perforator 7 moves, it will turn at an angle set by the slot 23 of the template 22 due to the pins 24 screwed into the housing of the cock device 5. The slope of the slot cut by the perforator 7 will repeat the slope of the slot 23 in the guiding template 22.

Figure 4:
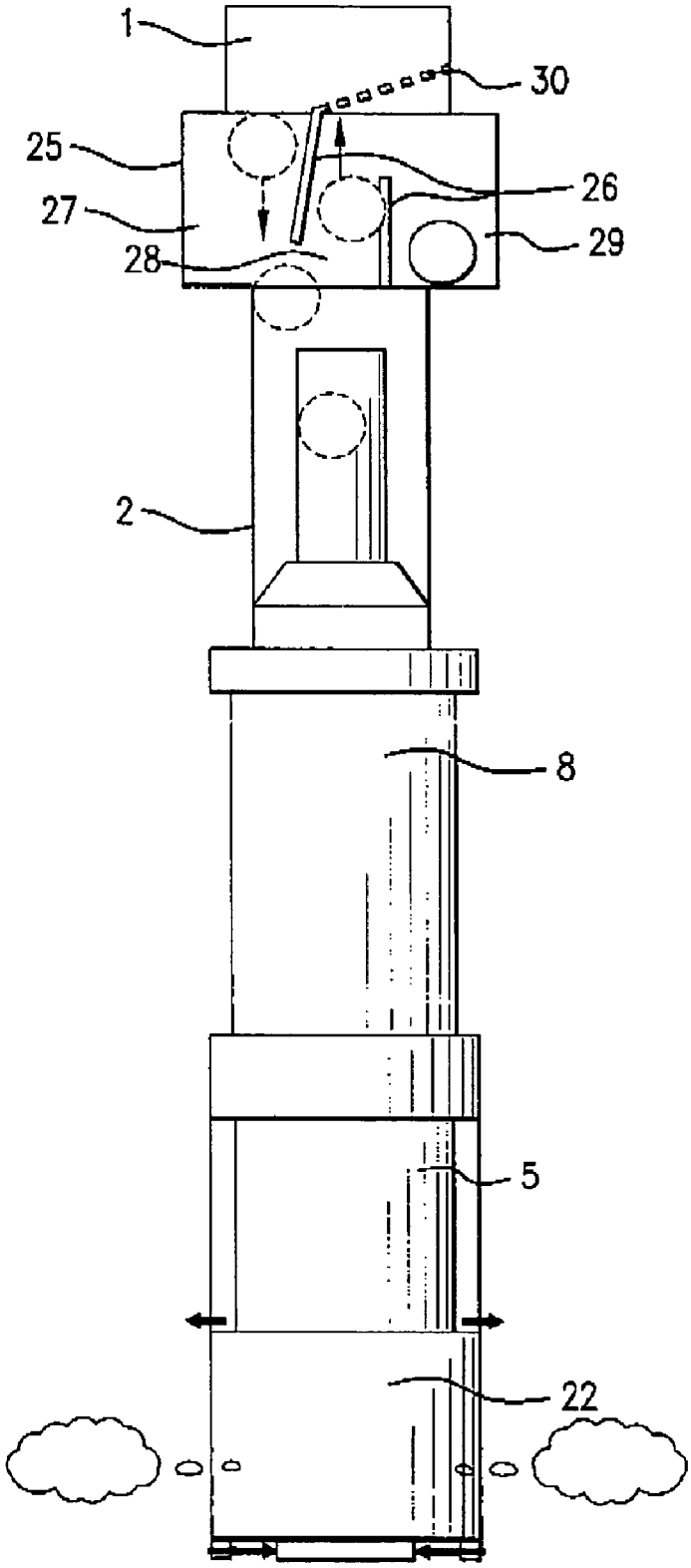
FIG. 4 shows an example of construction for catching a ball.

Referring to FIG. 4, an embodiment of a ball catcher is shown. The socket 25 for catching the balls comprises the socket having inner vertical walls 26 and divided into three sectors. The first sector is connected by a passage only with the second, adjacent sector 28. The second sector 28 is connected by a passage with the lower end of the socket. The third sector 29 is connected at the top by a passage with the upper end of the socket 25. In so doing, the second sector 28 and the first sector 27 are connected to each other at the lower part by a hole. The reflecting lattice 30 is disposed above the second sector 28 and the third sector 29. The lattice has a cell size smaller than the diameter of the smallest ball. The lattice 30 is made inclined and rising to the socket wall.

Figure 5:
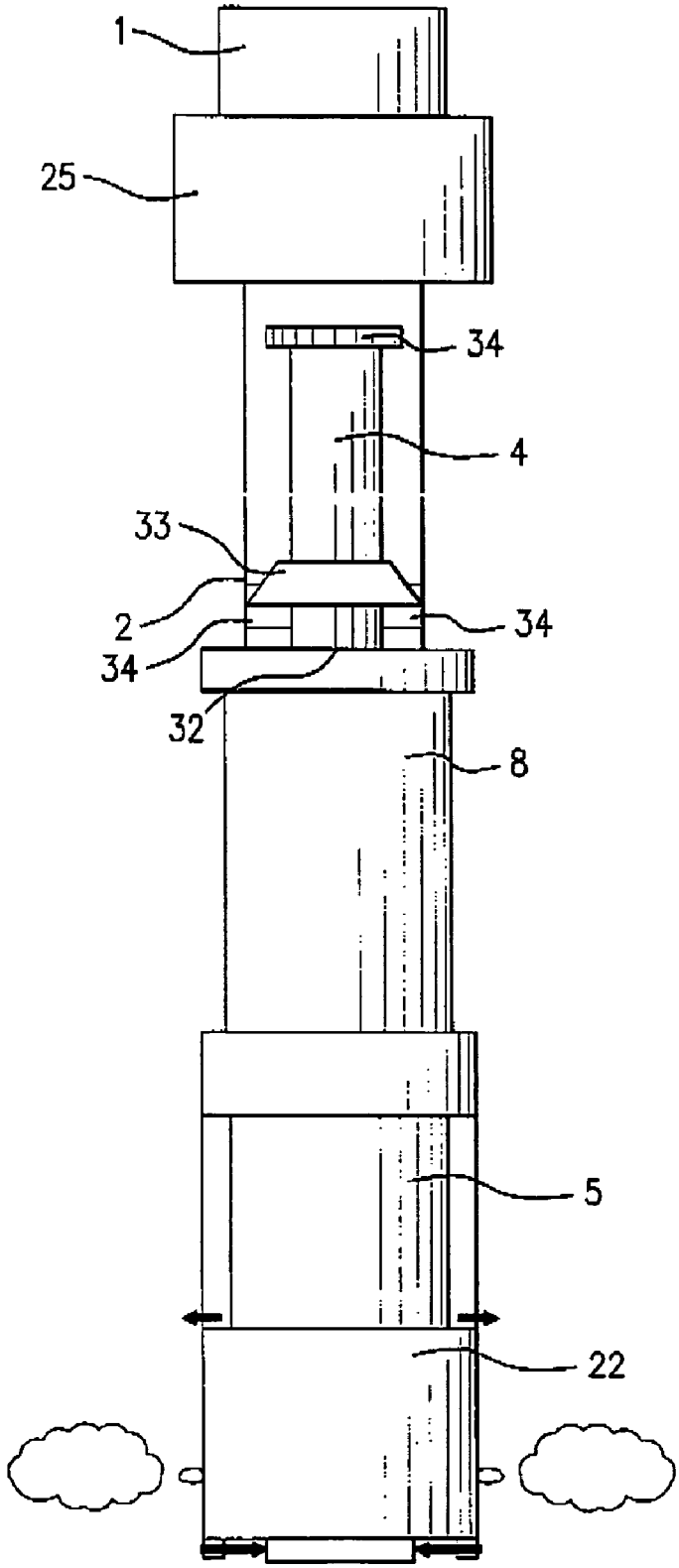
FIG. 5 shows an example of a device for signaling a completion of a stroke of a tube.

Referring to FIG. 5, an embodiment of the device signaling the completion of a stroke comprises openings/orifices 31 disposed above the hydro-brake top plug in the tube housing. The openings/orifices 31 are normally closed by the differential piston 32 having the moveable gate 33. The moveable gate 33 of the differential piston 32 is implemented with an option to open during a downwards vertical displacement. At the upper end of the inner tube 4 an external protrusion 34 is made for engaging the moveable gate 33 of the differential piston 32.

The apparatus for cutting slot-shaped key seats operates as follows. The housing tube 2 is jointed by means of pipe coupling with the tubing 1, the second end of tubing 1 is connected to pump unit of the surface equipment. The top chamber 9 is filled with a viscous liquid. The amount of the liquid for each cutting process is chosen in accordance with the slot length and depth and calculated in advance based on the known parameters of the channel 15 (capillary) connecting the chambers 9 and 10, temperature dependence of its sizes and the fluidity of liquid, as well as the pressure of the pump unit. Then the apparatus housing 2 (along with the inner tube 4, hydro-brake 8, cock device 5, hydro-abrasive perforator 7, and ball valve 6 disposed therein) is lowered to the predetermined depth, so that the nozzles of hydro-abrasive perforator 7 are disposed inside the well at the place where the top edge of the slot should be cut. A ball is dropped into the inner tube 4 (in order to close the ball valve 6). The pump unit of the surface equipment is turned on, and it begins to pump the abrasive mixture with the predetermined (rated) pressure into the inner tube 4. The mixture passes down to the ball valve 6 and closes it tightly. The hydro-abrasive perforator 7, via nozzles, begins to cut slots, first in the casing walls, then in the wellside zone. The depth of cutting of a future slot depends, in particular, on the time during which the cutting is performed. Pressure within the inner tube 4 (through which the abrasive liquid is pumped under pressure) pushes the inner tube 4 down and out the housing 2 rigidly mounted on the tubing 1. A slow cross-flow of liquid from the top chamber 9 of hydro-brake 8 into the bottom chamber 10 occurs. Thus, the inner tube 4 with the perforator 7 mounted thereon is slowly lowered down, and the rate of its movement defines the depth of (slot) cutting. At that time, only the cock spring 5 pushes from below against the plug 12 of the bottom chamber 10, which pressure is chosen essentially less than pressure against the top plug 11. In other words, the pressure of the cock spring 5 does not impede the cross-flow of the liquid from the top chamber 9 into the bottom chamber 10. This process of slow lowering (in the presence of pressure in the tubing 1) lasts until the all of the oil from the bottom chamber is forced to flow into the top chamber. I.e., the characteristics of viscous liquid poured initially into the bottom chamber 9 define the height of cutting, or the future slot. The duration of the cross-flow defines the rate of lowering of the apparatus for cutting slots, i.e., the depth of cutting of such slot. If the necessary cutting height is achieved before all the oil in the top chamber cross flows into the lower chamber, then at that moment the pressure in the tubing 1 is released, and the process of cutting slot and cross-flowing of liquid is stopped. In doing so, since pressure against the top plug 11 of hydro-brake 8 is released, the cock spring 5 pushes viscous liquid out of the bottom chamber 10 into the top chamber 9 while raising the inner tube 4 into initial position. The same process occurs after all of oil is squeezed out into the bottom chamber 10, if the pressure in the tubing 1 is withdrawn at that time.

Turning again to FIG. 2, the hydro-brake 8, which is an device for the cross-flow of a viscous liquid between chambers, operates as follows. It comprises two hermetic chambers 9 and 10 disposed vertically and limited by the top plug 11 and the bottom plug 12. Said chambers are filled with viscous liquid and divided by the moveable piston 14. The piston has the channel 15 for the cross-flow of viscous liquid between chambers, the top plug 11 rigidly joined with the case 2 and moveably joined with the inner tube 4, the piston 14 is rigidly joined with the inner tube 4 and moveably joined with the case 2, and the bottom plug 12 is moveable relative to the both tubes and pushes against the stop mounted at the inner side of the hydro-brake housing. The displacement of the plug 12 ensures the pressure equal to the pressure outside of tubes, which reduces the requirements to the strength of the housing of hydro-brake 8. The downwards displacement of the inner tube 4 occurs due to the pressure created in the tubing 1 and inner tube 4. The rate of that displacement depends on the rate of the cross-flow of viscous liquid through the channel 15 (capillary) in the piston 14. The pressure within the inner tube 4 (through which the abrasive liquid is supplied under pressure) pushes the inner tube 4 down and out the housing 2 rigidly mounted on the tubing 1. A slow cross-flowing of viscous liquid from the top chamber 9 of hydro-brake 8 into the bottom chamber 10 occurs, wherein the time this cross-flowing depends on the channel 15. Thus, the inner tube 4 with the perforator 7 mounted thereon is slowly lowered down, and the rate of its displacement defines the depth of (slot) cutting. At that time, only the cock spring 5 pushes from below against the plug 12 of the bottom chamber 10. That pressure is chosen to be essentially less than pressure on the top plug 11, i.e., the pressure of the cock spring 5 does not impede the liquid from cross-flowing from the top chamber 9 into the bottom chamber 10. This process of slow lowering (in the presence of pressure in the tubing 1) lasts until the all of the oil disposed in the bottom chamber is squeezed into the top chamber. The volume of viscous liquid initially filled into the bottom chamber 9 defines the height of the cutting process, or the future slot. The duration of the cross-flowing process defines the rate of lowering of the apparatus for cutting slots, and, therefore, the depth of the slot. If the necessary cutting height is achieved before all the oil in the top chamber is used up, then at that moment the pressure in the tubing 1 is released, and the process of cutting the slot and the cross-flowing of liquid is stopped. When that happens, since the pressure against the top plug 11 of hydro-brake 8 is released, the cock spring 5 pushes viscous liquid out of the bottom chamber 10 into the top chamber 9 while raising the inner tube 4 into its initial position. The same process occurs after the all of the oil is squeezed into the bottom chamber 10, if the pressure in the tubing 1 is released at that time.

Turning back to FIG. 3, the guiding device for determining the direction of slot cutting operates as follows. While the perforator 7 moves downwardly due to the working pressure in the inner tube 4, the guiding template 22 joined rigidly to the perforator 7. The perforator 7 turns at an angle defined by the slots 23 of the template 22 and the pins 24 threaded into the body of the cock spring 5. The slope of the vertical symmetry axis of the slot relative to a vertical line will repeat the slope of the slot 23 of the guiding template 22.

Turning back to FIG. 4, the socket 25 for catching balls operates as follows. A ball dropped into the tubing passes through the first sector 27, since the two other sectors 28 and 29 are closed with the reflecting lattice 30. Then, depending on the diameter of a ball, the ball falls into a socket of one of valves and seals it. After the reverse washing at a speed sufficient to raise the ball valve 6 into the tubing 1, the ball enters the second sector 28, hits the reflecting lattice 30 from below and falls into the "dark" third sector 29. The inner tube 4 is now empty, and all valves are open. That way the unencumbered forward and backward washing of the well can occur.

Turning back to FIG. 5, the device signaling the completion of a stroke of the inner tube 4 operates as follows. The inner tube 4 is lowered down during the work cycle and reaches the end of the cycle when its upper end reaches the top plug 11 of the hydro-brake 8. Openings/orifices 31 connecting the inner space of tube with the outside of the tube are disposed above top plug in the tube housing 2 and are closed by the differential piston 32 having the moveable gate 33 in the normal position. In the upper part of the inner tube 4 is arranged the external projection 34. At the end of the stroke, the projection 34 pushes against the moveable gate 33 and opens the openings/orifices 31 due to the movement of the differential piston 32. The process goes on in an increasing manner, since after connecting the inside and outside of the tube the differential piston 32 cannot remain in the upper position, and moves into its lower position under its own weight and under the force of the flow incoming into openings/orifices 31. At the surface, this process can be detected by a pressure drop in the tube space due to the presence of additional circulation between the inside and outside of the tube.

The proposed technical solutions comprise a number of important improvements distinguishing it advantageously from all analogous devices. Let us consider this in more detail.

1) The channel 15 through which viscous liquid cross-flows between the hydro-brake chambers 10 and 9 is formed between the matrix 18 and the punch 17 made as mutually coinciding recesses and protrusions. Since the depth of a recess is greater than the height of a protrusion, their space between them forms the section of the channel (capillary) 15. The matrix 18 is elastically pressed against the punch 17 with a predetermined force, and the matrix and the punch can be displaced a short distance relative to each other. This displacement occurs if the pressure at one end of the channel 15 becomes greater than the pressure which joins the matrix and the punch together. Once the flow of the liquid through the capillary slows down, the pressure at one end of the channel 15 starts to exceed the shift force, and the moveable matrix 18 moves (shifts) relative to the punch 17. The channel 15 widens, thereby eliminating the slowing down effect.

2) The shape of the recesses of the matrix 18 is chosen not semispherical, but, for example, as a trapezoid. Therefore, the smallest displacement of the matrix 18 relative to the punch 17 with the triangularly shaped protrusions recess alters significantly the cross-section of the channel, thereby eliminating the effect of slowing down of the flow of liquid through the capillary, and returning the channel into its initial, predetermined position once pressure equalizes.

3) The matrix 18 is made of an elastic material (e.g., of caprolactam, variety of polytetrafluorethylene-rubber, etc.) characterized by the lesser hardness than that of the punch 17. At a predetermined push of the matrix 18, the channel 15 has the predetermined cross-section, and the known flow rate of the liquid through the channel. Altering the strength of the push results in altering the cross-section of the channel 15, therefore, altering (or setting) the speed of the hydro-abrasive perforator.

4) Recesses and protrusions could be made in the shape of concentric circles disposed at the surface of the matrix (or punch). The direction of the flow of viscous liquid is chosen from the center to the outer ends. Thus, the flat channel of a variable cross-section is provided. The flow and consumption of the liquid can be easily determined. The slowing down of the flow of the liquid through the channel can be eliminated.

5) The materials of the matrix and the punch have different thermal expansion coefficients. They are selected in such a way that the temperature variation within a given range proportionally decreases the cross-section of the channel. Then the volume of the liquid cross-flowing through the channel remains constant or at least changes less. For example, the matrix could be made of caprolactam and the punch could be made of duralumin. In practice, such a device flowed through itself 20–50 milliliters of MC oil per minute at the pressure differential 4.0–5.0 MPa in the temperature range from +20 to +70° C.

6) Information about the speed of the hydro-abrasive perforator is received via the signal of the completion of the perforator's stroke. Through openings/orifices are formed in the housing tube 2 that couples the hydro-abrasive perforator's engine with the pumping compressing tubing 1, which through openings are normally closed by the differential piston. Once the inner tube 4 lowers into the lower bottom position, the inner tube moves the moveable gate of the differential piston by means of a special external protrusion and opens the through openings. Therefore, the inside and outside of the tube are connected via the openings. The completion of the working stroke is ascertained by a drop in the working pressure.

7) In order to shorten a time of washing out metal balls, i.e., valves, the socket 26 for catching balls is introduced into the construction of hydro-abrasive perforator moving device. This socket has an enlarged length as compared with the standard one for the size equal to the sum of diameters of all metal balls assumed to be used during operation. The socket diameter is equal to three diameters of the greatest metal ball assumed to be used plus the socket wall thickness ensuring a safe operation at the predetermined depth with an operation pressure and weight of apparatus for performing work plus eighteen millimeters, i.e., three wall arranged within the socket. The socket 26 is divided by separating walls into three sectors (27–29) for the whole length: the first sector 27 has a communication only with the second sector 28, the third sector 29 has a communication with the upper socket end, and the second sector 28 has a communication with the lower socket end. In so doing, the first and second sectors connected with the upper and lower socket ends are connected each other in the bottom part by means of a hole having the diameter more than the diameter of the greatest metal ball. The third, "dark", sector 29 is connected in the upper ("dark") part by the hole with the second sector 28 having the connection with the lower part of socket by means of a hole having the diameter more than the diameter of the greatest metal ball. Such a device allows one to use a hydro-abrasive perforator with a nose-blade, which, in turn, allows one to perform the face washing and normalizing without additional tripping operation.

EXAMPLE

The present technical solutions were tested repeatedly in practice. It was not difficult to manufacture such an apparatus industrially, since all elements, materials, technologies necessary for the manufacturing of those apparatuses have long been developed. The cost of the claimed apparatus does not differ substantially from the cost of the analog devices.

The claimed apparatuses were tested for increasing the productivity of oil, gas and pressure wells and implemented in practice, particularly in the wells of the Yamburg gas-condensate deposit in January–February 2004, Yamburg, Russia, and in the wells of Yen-Yakhinskoe oil-gas-condensate deposit in July–August 2004, Novy Urengoy, Russia. These tests confirmed the suitability of the proposed apparatus for operation and its ability to achieve the stated tasks. Thus, the present apparatus was used in four productive beds in various wells were treated at the depths of 3060–3870 meters with the average thickness of 8–10 meters. In two cases, key seats were made at the at the 60° between of the vertical symmetry axis of the apparatus and a vertical line. In each case, the spiral-shaped slot was cut through the whole thickness of productive formation with the pitch of 1.2–1.3 meters. In all cases, a clear and unequivocal signal of the completion of stroke was received (32 times—the pressure dropped from 40–20 MPa to 8–12 MPa). In every case, upon completion of the work and then when washing was performed to remove sand and sludge (done twice), the balls were received in the socket of the catcher in 5–7 minutes of the backward washing process. The productivity of the wells was initially 30–60 thousands cubic meters of gas per day. Prior to making key seats in accordance with the present technology, at all of the referenced productive beds the work to increase productivity was performed by using other known methods: hydro-sandblasting perforation and slot cutting. In so doing, none of the known productivity increase methods has demonstrated a significant increase in productivity of those wells. After the wells were treated in accordance with the proposed method, their productivity has increased up to 120–160 thousands cubic meters per day.

Since the analogous devices were used at the same wells prior to the present invention, then it was possible to perform a direct comparison of their productivity. Labor-intensity of the identical operations has been reduced almost by a half (mainly due to accelerating of the extraction of valve balls, reducing the number of stoppages and reinstallations of the cutting equipment), and the productivity of treated wells has increased to 250–300% (due to the more precise cutting of the calculated slot sizes in the wellside zone). Besides, the lifetime of cutting devices and the convenience of their maintenance increased due to ensuring the stable mode of operation, more effective use of the nozzle resource (no cutting of the unnecessary), and operative control of the cutting process. Thus, the stated tasks of the present invention were implemented.

What is claimed is:

1. An apparatus for cutting of slot-shaped key seats in a well by a hydro-sandblasting method, the apparatus comprising:

a tube housing rigidly and hermetically joined with an end of a pumping compressing tube:

an inner tube moveably and coaxially mounted inside the tube housing, the inner tube being spring-loaded from below with a cock spring;

a top plug rigidly joined with the housing and moveable joined with the inner tube, and a bottom plug moveably joined with the housing and the inner tube;

a hydro-abrasive perforator and a lower ball valve mounted at a lower end of the inner tube, the ball valve being disposed below the perforator;

a hydro-brake comprising two vertical hermetic chambers disposed between the top plug and the bottom plug, the two chambers being divided by a piston with a self-adjusting channel for cross-flowing of a fluid between the two chambers, the piston being rigidly joined with the inner tube and moveably joined with the housing;

the self-adjusting channel being formed between a matrix and a punch elastically pressed against each other and made as mutually coinciding recesses and protrusions, which are larger in size than the recesses.

2. The apparatus of claim 1, wherein the recesses and the protrusions are made in the shape of concentric circles.

3. The apparatus of claim 1, wherein the recesses and the protrusions are in the shape of a trapezoid.

4. The apparatus of claim 1, wherein the recessions of the matrix are in the shape of a trapezoid and the protrusions of the punch are triangular.

5. The apparatus of claim 1, wherein the matrix is made of an elastic material of a lesser hardness than that of the punch material.

6. The apparatus of claim 1, wherein the materials of the matrix is caprolactam and the material of the punch is aluminum.

7. The apparatus of claim 1, further comprising an upper ball valve is mounted on the upper end of the inner tube, the diameter of the upper ball valve being larger than the diameter of the lower ball valve;

a socket for catching balls disposed above the upper ball valve, the socket being divided into three sectors, the first sector being connected at its bottom only with the second sector adjacent to the first sector, the second being connected at its bottom with an lower end of the socket by a passage, the third sector being connected at its top with an upper end of the socket; and a reflecting lattice is disposed above the second and third sectors having a cell size smaller than that of the upper ball valve and the lower ball valve.

8. The apparatus of claim 7, wherein an angle between the reflecting lattice and a socket wall is at least 60°.

9. The apparatus of the claim 1, further comprising, guiding template rigidly connected to the housing, the guiding template being made of a slotted tube with pins inserted into the slotted tube, the pins being mounted on a housing of the cock spring.

10. The apparatus of the claim 1, wherein a portion of the housing disposed above the top plug comprises a plurality of openings closed with a differential piston having a moveable gate, the opening being closed by the differential piston in a normal position and the moveable gate being implemented with an option to open during a downward displacement, wherein the upper end of the inner tube comprises an external protrusion for engaging the moveable gate.

* * * * *